US011477579B2

(12) United States Patent
King

(10) Patent No.: US 11,477,579 B2
(45) Date of Patent: Oct. 18, 2022

(54) DIAGNOSTICS FOR ACOUSTIC DEVICES AND METHODS

(71) Applicant: Knowles Electronics, LLC, Itasca, IL (US)

(72) Inventor: Charles King, Oak Park, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/287,229

(22) PCT Filed: Oct. 21, 2019

(86) PCT No.: PCT/US2019/057176

§ 371 (c)(1),
(2) Date: Apr. 21, 2021

(87) PCT Pub. No.: WO2020/086444

PCT Pub. Date: Apr. 30, 2020

(65) Prior Publication Data

US 2021/0385582 A1 Dec. 9, 2021

Related U.S. Application Data

(60) Provisional application No. 62/748,665, filed on Oct. 22, 2018.

(51) Int. Cl.
*H04R 11/02* (2006.01)
*H04R 7/16* (2006.01)

(52) U.S. Cl.
CPC ..... *H04R 11/02* (2013.01); *H04R 7/16* (2013.01)

(58) Field of Classification Search
CPC ..... H04R 7/16; H04R 11/02
See application file for complete search history.

(56) References Cited

U.S. PATENT DOCUMENTS 8,401,215 B2 3/2013 Warren et al.
9,226,082 B2 12/2015 Friis et al.
9,775,998 B2 10/2017 Fredelake
(Continued)

FOREIGN PATENT DOCUMENTS

CN 204206447 U 3/2015
CN 204206449 U 3/2015
(Continued)

OTHER PUBLICATIONS

European Patent Office; International Search Report and Written Opinion; International Application No. PCT/US2019/057176; dated Feb. 10, 2020.

*Primary Examiner* — Sunita Joshi

(57) ABSTRACT

An acoustic device and method generates an acoustic signal by applying an excitation signal to a first coil disposed about an armature of an acoustic receiver. A second coil magnetically coupled to the first coil generates an electrical output signal in response to the excitation signal applied to the first coil, wherein the output signal of the second coil is indicative of a change in a state or operation of the receiver or acoustic device. In some embodiments, the first and second coils are wired independently of each other, and the acoustic device further includes an electrical circuit which determines the change in the acoustic performance based on a change in the electrical output signal of the second coil.

20 Claims, 13 Drawing Sheets

(56) References Cited

U.S. PATENT DOCUMENTS

| | | | | |
|---|---|---|---|---|
| 2003/0163022 | A1* | 8/2003 | Miller | H04R 25/606 600/25 |
| 2010/0254556 | A1 | 10/2010 | Warren et al. | |
| 2014/0153737 | A1 | 6/2014 | Geschiere et al. | |
| 2014/0270206 | A1 | 9/2014 | Port | |
| 2019/0327563 | A1 | 10/2019 | King et al. | |

FOREIGN PATENT DOCUMENTS

| | | | | |
|---|---|---|---|---|
| CN | 204906666 | U | 12/2015 | |
| EP | 1467595 | A2 | 10/2004 | |
| WO | 2007/144010 | A1 | 12/2007 | |
| WO | 2012/107100 | A1 | 8/2012 | |
| WO | 2018/129242 | A1 | 7/2018 | |
| WO | WO-2018129242 | A1 * | 7/2018 | H04R 25/305 |

* cited by examiner

DIAGNOSTICS FOR ACOUSTIC DEVICES AND METHODS

RELATED APPLICATIONS

This application is a National Stage Entry of PCT Application No. PCT/US2019/057176, filed on Oct. 21, 2019, which claims benefit of U.S. Provisional Application No. 62/748,665, filed on Oct. 22, 2018, the entire contents of both are hereby incorporated by reference.

TECHNICAL FIELD

This disclosure relates generally to acoustic devices and more specifically to diagnostics in acoustic devices and corresponding methods.

BACKGROUND

Acoustic devices including a balanced armature receiver that converts an electrical input signal to an acoustic output signal characterized by a varying sound pressure level (SPL) are generally known. Such acoustic devices may be embodied as hearing aids, headsets, hearables, or ear buds worn by a user. The receiver generally includes a motor and a coil to which an electrical excitation signal is applied. The coil is disposed about a portion of an armature (also known as a reed), a movable portion of which is disposed in equipoise between magnets, which are typically retained by a yoke. Application of the excitation or input signal to the receiver coil modulates the magnetic field, causing deflection of the reed between the magnets. The deflecting reed is linked to a movable portion of a diaphragm disposed within a partially enclosed receiver housing, wherein movement of the paddle forces air through a sound outlet or port of the housing.

The performance of such acoustic devices may be adversely affected by an obstruction of the acoustic output signal. Such an obstruction may be caused by an accumulation of foreign matter in some portion of the acoustic device. Foreign matter includes moisture, earwax, also known as cerumen, or other debris, and combinations thereof tending to infiltrate the acoustic device. For example, the obstruction may occur in a sound port of an earbud or earpiece of the acoustic device, or in a tube interconnecting the sound port to an output port of the receiver. In some acoustic devices, the foreign matter may migrate through structure toward and accumulate in portions of receiver.

For example, International Patent Publication No. WO/2018/129242 published Jul. 12, 2018, titled "Load Change Diagnostics for Acoustic Devices and Methods", discloses determining whether there is a change in the acoustic signal indicative of a change in an acoustic load coupled to the receiver by comparing the electrical output signal to reference information, where the change in acoustic load is attributable to ear wax accumulation in an output of the acoustic receiver or acoustic passage in the ear canal of a user or is attributable to seal leakage.

As another example, U.S. Pat. No. 7,949,144 issued May 24, 2011, titled "Method for Monitoring a Hearing Device and Hearing Device with Self-Monitoring Function", discloses monitoring a hearing device having an electroacoustic output transducer worn at a user's ear or in a user's ear canal, by measuring the electrical impedance of the output transducer; analyzing the measured electrical impedance of the output transducer in order to evaluate the status of the output transducer and/or of an acoustical system cooperating with the output transducer; and outputting a status signal representative of the status of the output transducer and/or of the acoustical system cooperating with the output transducer. However, both of the above prior-art examples require a considerable amount of power to be taken away during the measurement process, thereby proving costly to the battery power of the hearing device. Some prior art receivers include multi-tap coils. Such multi-tap coils may be formed as bifilar coils where the two coils are wound in a closely spaced, parallel configuration, such that one end of the first coil is electrically coupled to one end of the second coil through one of the terminals or electrical contacts located on the receiver housing. The contact that receives the end of the two coils acts as a center. In some applications, the center tap is grounded. In other applications, the center tap is not grounded, and the alternate winding merely acts to change the inductance of one of the coils coil.

Another prior art example employs an acoustic receiver with three electrical contacts, or connectors, in a three-contact configuration where two of the contacts are electrically coupled with an amplifier which sends acoustic signals to a main coil within the receiver to output sound, and the remaining contact is coupled with a ground. Furthermore, an identification resistor is coupled with the ground and an electrical circuit which uses the resistor to identify the type of receiver being used. For example, the electrical circuit initially applies a predetermined voltage to the resister and measures an electrical current flowing through the resistor in response. The measured current is used to calculate the resistance by dividing the applied voltage value, which is the same as the voltage drop through the resistor because the other end of the receiver is coupled with the ground, by the measured current value. As such, the resistor is used solely for identifying the receiver, and the contact on the receiver which is coupled with the ground is used to link the receiver with the resister which identifies it, and thus the receiver requires another method to determine if there is a blockage in the receiver.

BRIEF DESCRIPTION OF THE DRAWINGS

The objects, features, and advantages of the present disclosure will be more apparent to those of ordinary skill in the art upon consideration of the following Detailed Description with reference to the accompanying drawings.

Figure 1:
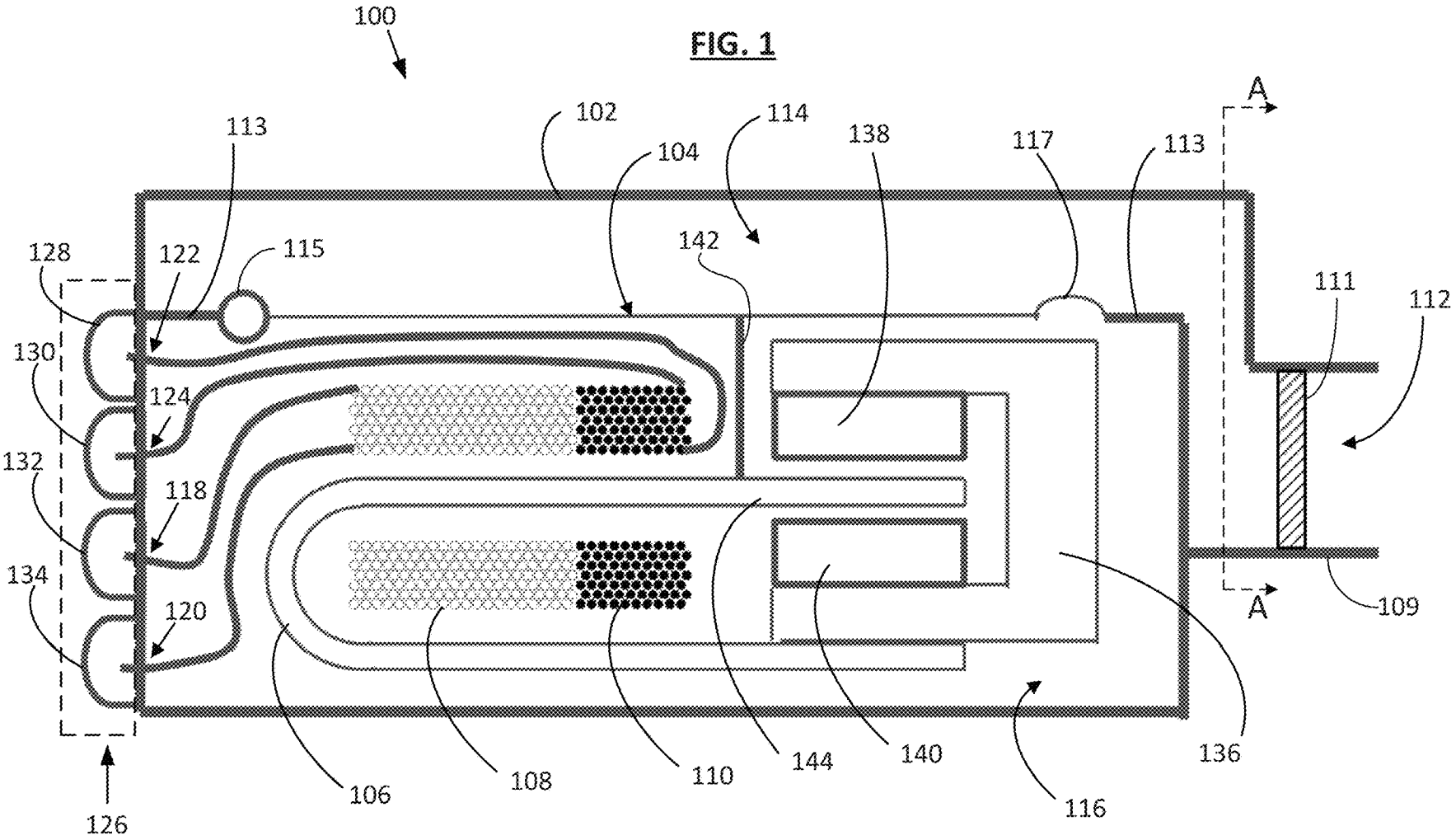
FIGS. 1 to 5 are schematic diagrams of an armature-based receiver with two coils in various different configurations.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

The present disclosure pertains to acoustic devices and methods for producing an acoustic output signal in response to an electrical input signal, in which the acoustic devices include an acoustic receiver (also referred to herein as a "receiver") with two magnetically coupled, independently wired coils. The acoustic device may be embodied as a hearing aid, a behind-the-ear (BTE) hearing device with a portion that extends into or on the ear, an in-the-canal or partially in the ear canal hearing device, a headset, a wired or wireless earbud or earpiece, or as some other device that produces an acoustic output signal in response to an electrical input signal and is intended for use on, in, or in close proximity to a user's ear.

In one embodiment, an excitation signal is applied to the first of the two coils, disposed about a portion of an armature of the receiver, to generate an acoustic signal. In response to a resulting change in magnetic flux in the receiver, an electrical output signal indicative of a change in a state of the acoustic device is generated across the second coil. In one example, each of the two coils has two electrical leads. In one embodiment, the receiver has four discrete electrical contacts, each of which is electrically coupled to a corresponding coil lead. In another embodiment, the receiver has three discrete electrical contacts, one of which is electrically coupled to a lead of both coils. In one example, the electrical output signal is indicative of an obstruction or distortion of the acoustic signal.

The two coils can have various configurations. In one example, the second coil is wound around a portion of an outer surface of the first coil, and in another example, the second coil is side-by-side with the first coil. In yet another example, the second coil is intertwined with the first coil. The first and second coils can have the same wire gauge or different wire gauges and/or the same or different numbers of turns. Also, separately from the receiver, the hearing device in one embodiment includes an electrical property uniquely identifying the receiver or a property of the receiver, such as using an identifying resistor electrically coupled with the receiver such that the hearing device can determine the type and/or model of the receiver by applying an electrical signal. In one example, the property of the receiver includes its resistance, or impedance.

In one example, an electrical circuit determines a change in the operation or acoustic performance of the receiver or acoustic device based on the change in the electrical output signal of the second coil. The electrical circuit may also apply the excitation signal to the first coil in embodiments that require the application of a signal to the first coil to generate an output from the second coil. The electrical circuit may be part of the receiver, or the acoustic device, or a host device like a cell phone to which the acoustic device is communicably coupled by wire-lines or wirelessly. In one implementation, the electrical circuit both applies the excitation signal to the first coil and subsequently compares one or more characteristics of the electrical output signal of the second coil to corresponding characteristics of an expected output signal. Such characteristics include but are not limited to a null position, a peak amplitude, and a null bandwidth, described further herein, to determine that there is change in the acoustic performance of the receiver, or the acoustic device.

In another example, the electrical circuit of the device detects an acoustic performance or acceleration of the acoustic device, the change in which is determined based on the change in the electrical output signal of the second coil. An acceleration may be detected in the absence of an excitation signal applied to the first coil. Whether the output of the second coil is used to detect acceleration or acoustic performance depends on the algorithm that processes the output signal. Some acoustic devices may be capable of detecting acoustic performance or acceleration or both.

In FIG. 1, the receiver is an armature-based receiver 100. The receiver 100 has a housing 102, a paddle 104, an armature 106 (also known as a reed), and a set of coils including a first coil 108 and a second coil 110. The housing 102 has an end portion 109 defining an acoustic output 112 through which sound may propagate toward a user's ear canal. In one example, the end portion 109 includes a barrier 111 which prevents contaminants such as earwax or any other foreign substance from entering the housing 102. The barrier 111 can be made of a porous material. The paddle 104, which is a part of a diaphragm, separates the volume inside the housing 102 into a front volume 114 coupled to the acoustic output 112 and a back volume 116. On one end, a support structure 113 moveably couples the paddle 104 to the housing 102 at a hinge 115, while on the other end, a flexible membrane 117 bridges a gap between the paddle 104 and the support structure 113. The support structure, the membrane and the paddle form the diaphragm. In FIG. 1, the first coil 108 has two leads 118 and 120, and the second coil 110 also has two leads 122 and 124, where the leads all connect to an electrical interface 126 located on the housing 102. In one embodiment, the electrical interface 126 has discrete electrical contacts 128, 130, 132, and 134, where the contacts are electrically isolated from each other. Examples of these contacts include pins, friction contacts, and solder pads, although other suitably configured structures can also be used. This embodiment with four electrically independent contacts is a "quad-contact" configuration.

The housing 102 additionally includes a yoke 136 which holds a pair of magnets 138 and 140 between which a portion of the armature 106 movably extends. A link 142 connects a movable portion 144 of the armature 106 with the paddle 104 such that the movable portion 144 deflects relative to the magnets 138 and 140 in response to application of an excitation signal to the first coil 108, also known as the driving coil, of the receiver 100.

According to one aspect of the disclosure, in FIG. 1, the first coil 108, disposed about a portion of the armature 106, and the second coil 110, also referred to as a monitoring coil, is positioned within the receiver to have a flux linkage to the first coil, similar to a transformer. The coils 108 and 110 are wired independently such that each of the four leads 118, 120, 122, and 124 electrically connects to a corresponding one of the four discrete electrical contacts 128, 130, 132, and 134.

Generally, the receiver generates an acoustic signal in response to an excitation signal applied to the first coil, and the second coil produces an electrical output signal in response to application of the excitation signal to the first coil. The excitation signal produces flux that is detected by the secondary coil via air link, the armature, yoke or some other structure of the receiver. The excitation signal applied to the first coil could be a test or reference signal that produces an expected output from the secondary coil when the receiver or acoustic device is in a particular state or reference condition. Such a condition or state may be where there is no obstruction in the output of the receiver or acoustic device, or where there is an ideal seal between the acoustic device and the user, or where the acoustic distortion is at a particular level, among other conditions. A change in the state or condition of the receiver or acoustic device will cause the output of the secondary coil to be different than the expected output when the reference signal is applied to the first coil.

In some applications, the difference between the output of the secondary coil and the expected output may indicate the extent to which the condition of the acoustic device has changed relative to the particular state or reference condition. For example, where the change in condition results from an obstruction due to wax accumulation in the acoustic device, the extent of the difference may indicate the extent of the obstruction. In this example, the processing algorithm could be configured to provide an alert when the obstruction exceeds a threshold and/or store such information for interrogation by the user or a technician. Such algorithms may be configured similarly for detecting changes in other conditions or states, examples of which are described herein.

In some embodiments, the first coil and the second coil have the same wire gauge for production efficiency, cost reduction and other considerations. In other embodiments, however, the wire gauges may be different. The second coil can use a smaller gauge wire than the first coil since the second coil carries less current. A smaller wire gauge on the second coil reduces space usage for a given number of windings relative to a larger gauge. Minimization of the space requirements for the first and second coils within the fixed volume of the receiver housing will lessen any adverse effect on receiver performance. The space requirement for the first and second coils may also be minimized by reducing the number of windings in the second coil. But a winding reduction in the second coil may reduce sensitivity. Thus, the number of windings and wire gauge of the second coil may be selected based on a trade-off between sensitivity and performance requirements among other factors. In other embodiments, the wire gauge of the second coil is selected to provide an electrical property that uniquely identifies the acoustic receiver, or a property of the receiver as described further herein.

Figure 2:
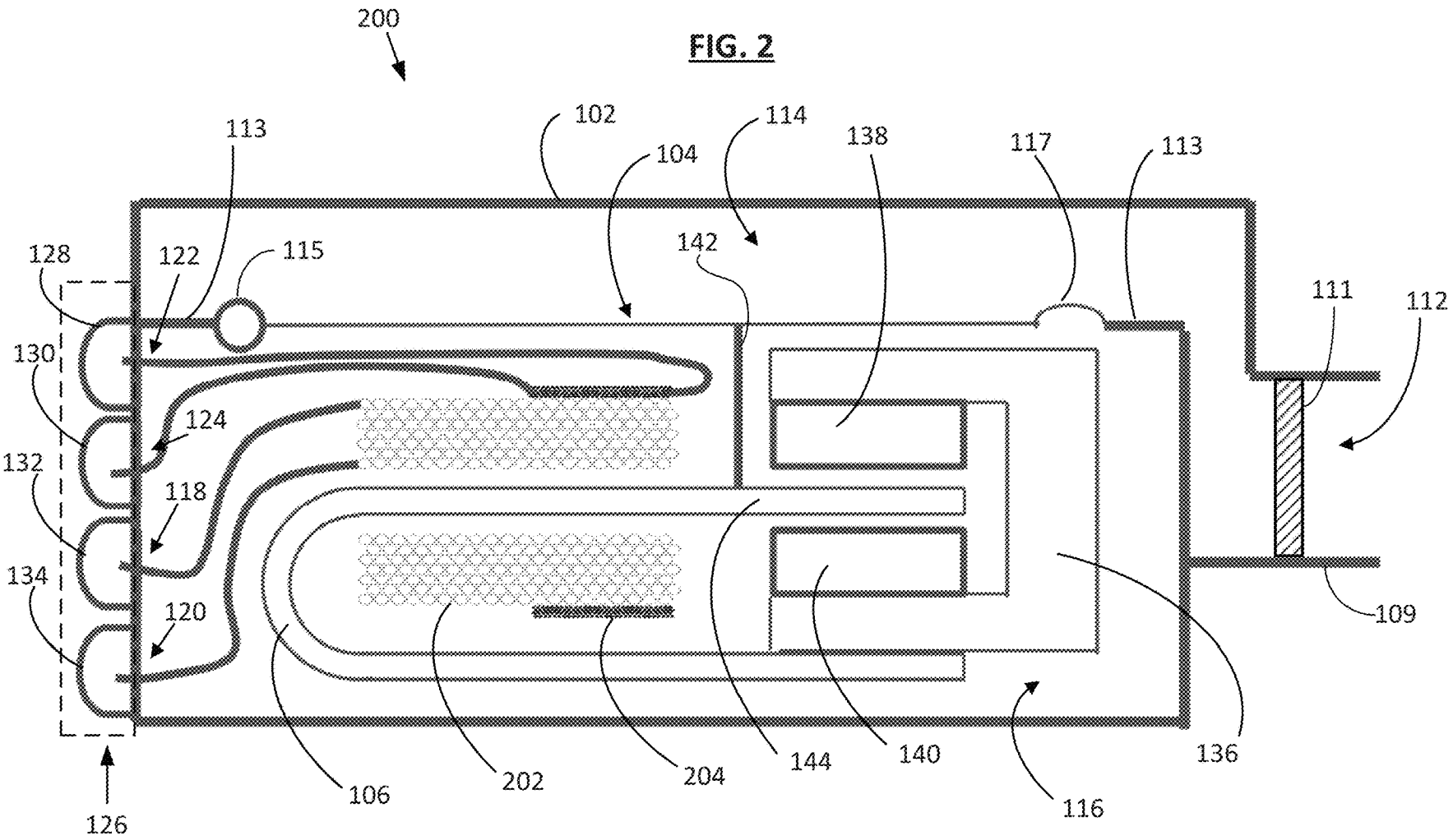
Figure 3:
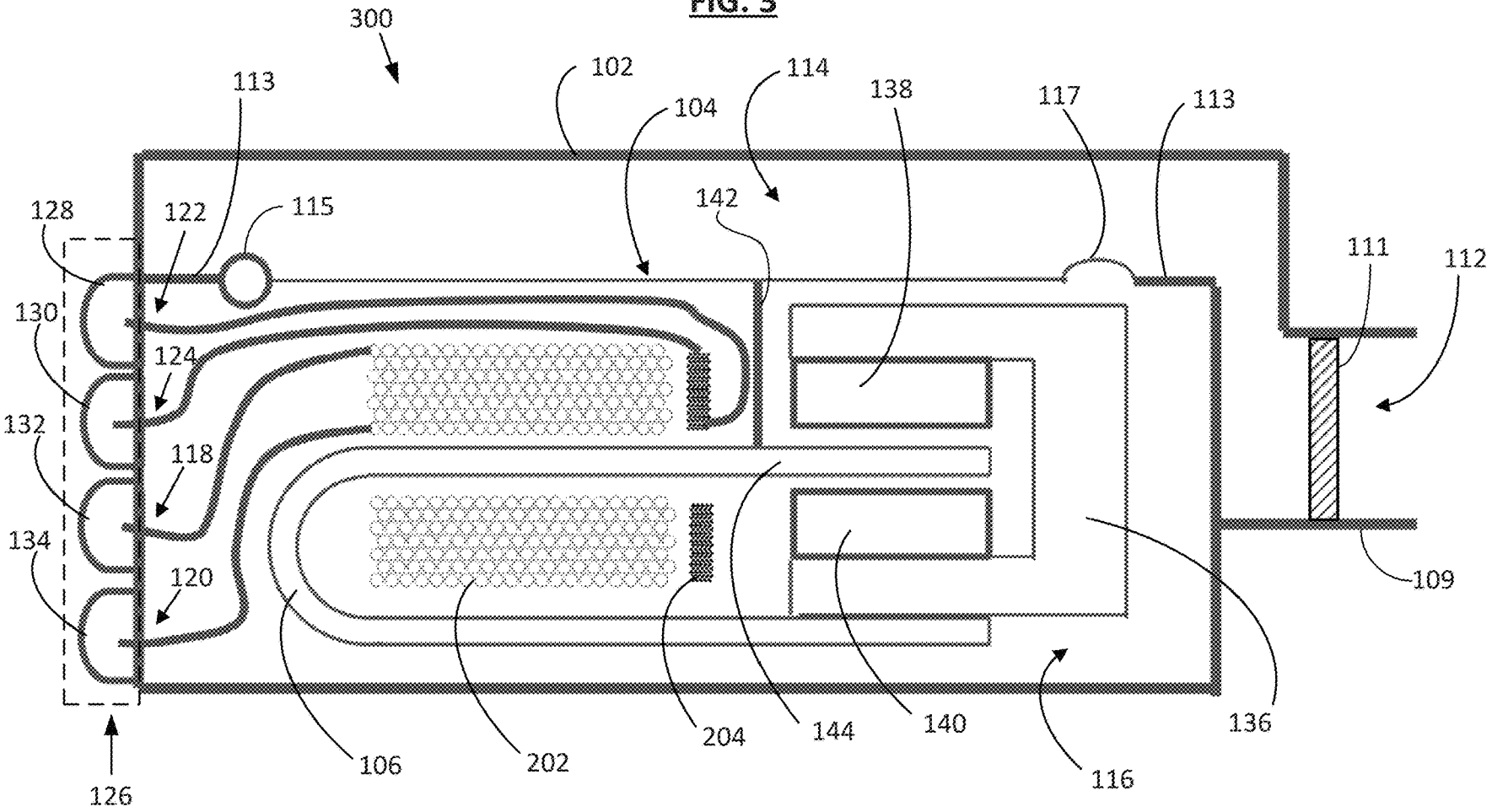
Figure 4:
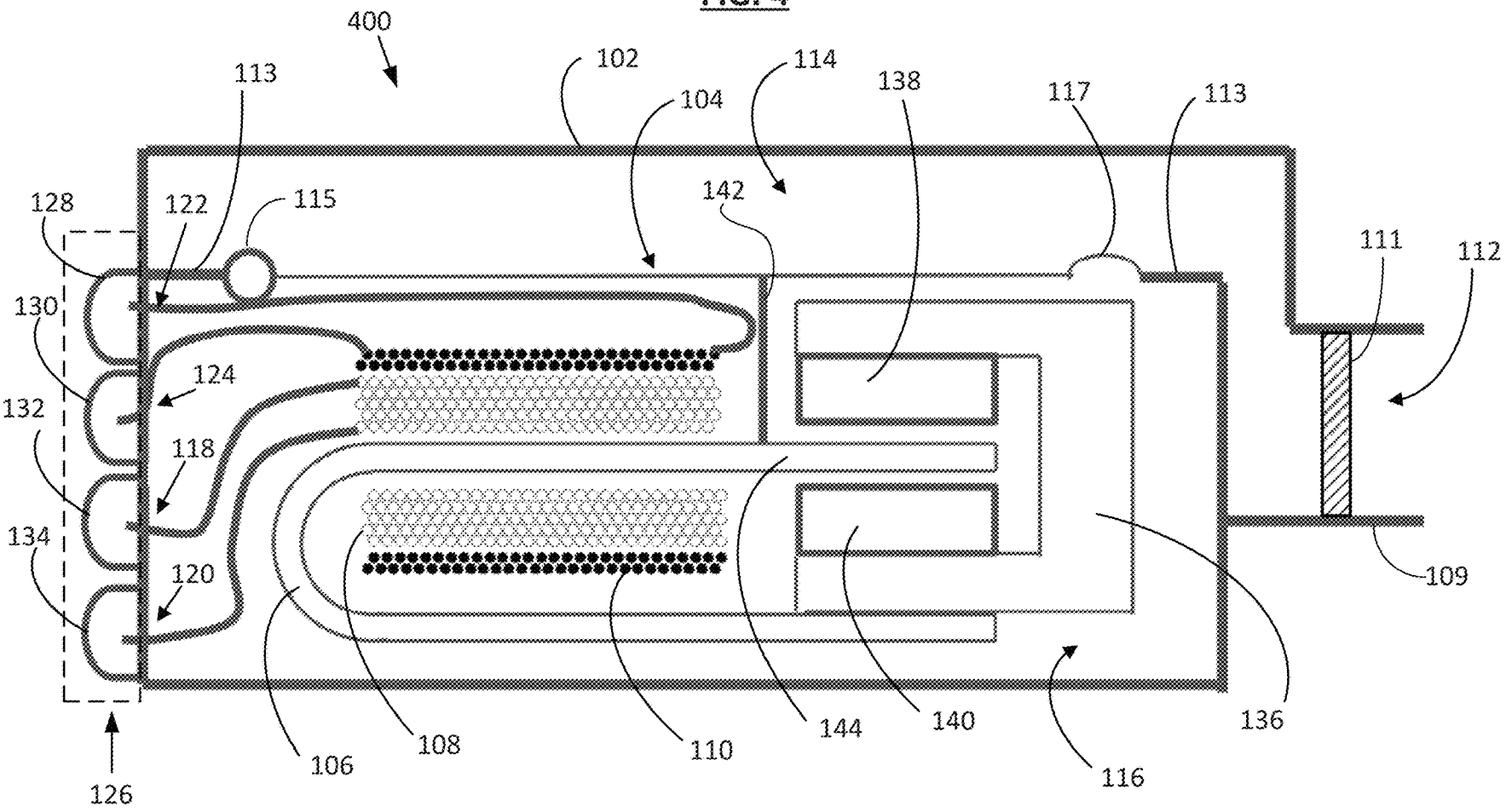
Figure 5:
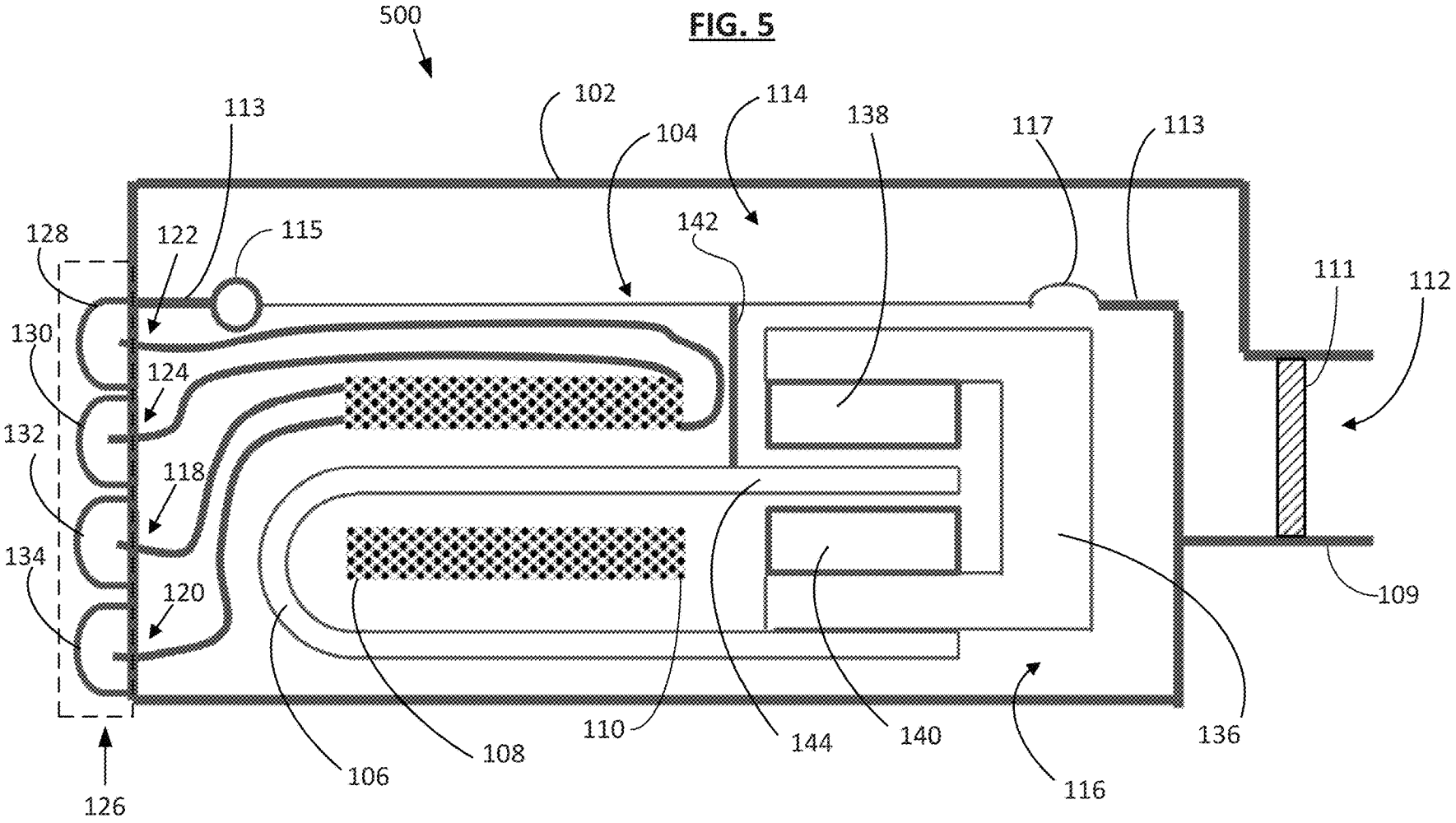

Each of the embodiments in FIGS. 1-5 contains a different configuration of first and second coils. The circles filled with white represent cross sections of the first coil, and the circles filled with black represent cross sections of the second coil. In FIG. 1, the second coil 110 is wrapped or configured around a portion of the armature 106, adjacent to the first coil 108, in a side-by-side configuration. In FIG. 2, the receiver 200 uses a different set of coils, where a second coil 204 has a wire gauge smaller than that of a first coil 202. The second coil 204 is wrapped about a portion of the outer surface of the first coil 202, adjacent to the first coil 202. In FIG. 3, the second coil 204 is wrapped around a portion of the armature 106, adjacent to the first coil 202, in a side-by-side configuration. In FIG. 4, the second coil 110 is wrapped around the first coil 108, adjacent to and covering the entire outer surface of the first coil 108. In FIG. 5, the receiver 500 has a first coil 108 and a second coil 110 wrapped around a portion of the armature 106, wherein the two coils are intertwined with each other.

Figure 6:
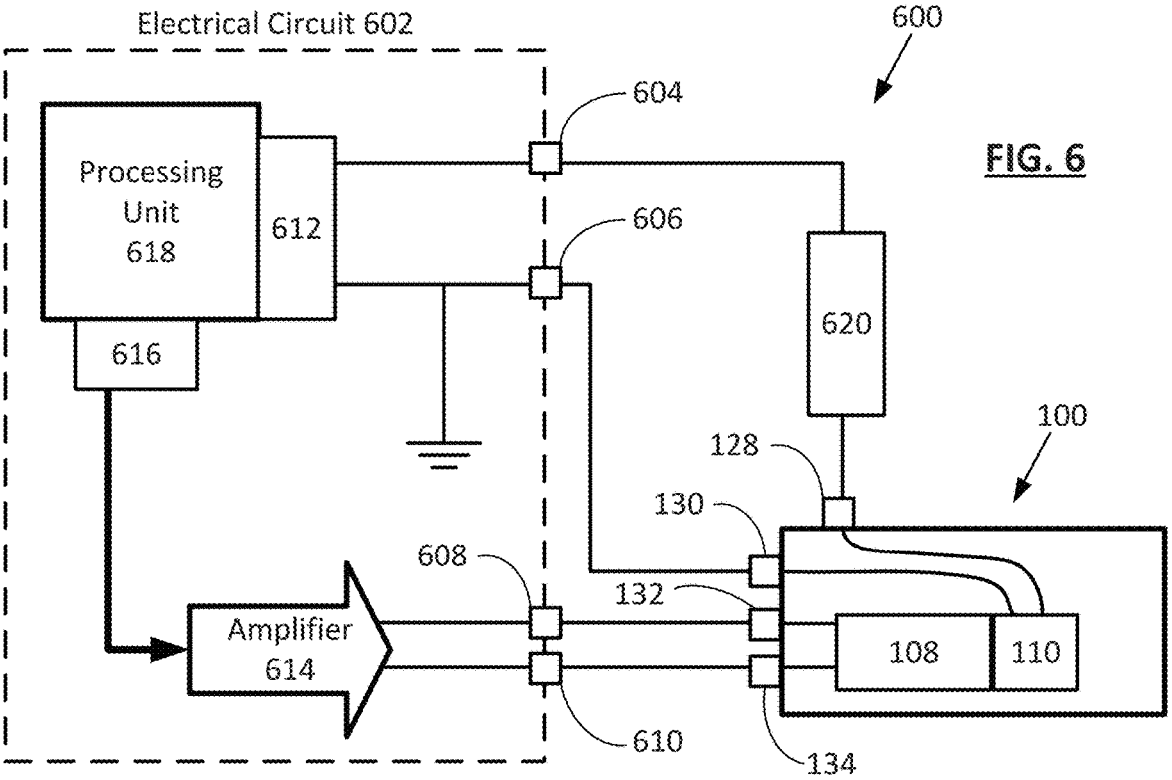
FIG. 6 is a schematic diagram of an acoustic device with a receiver and an electrical circuit, as well as an identifier resistor.
Figure 7:
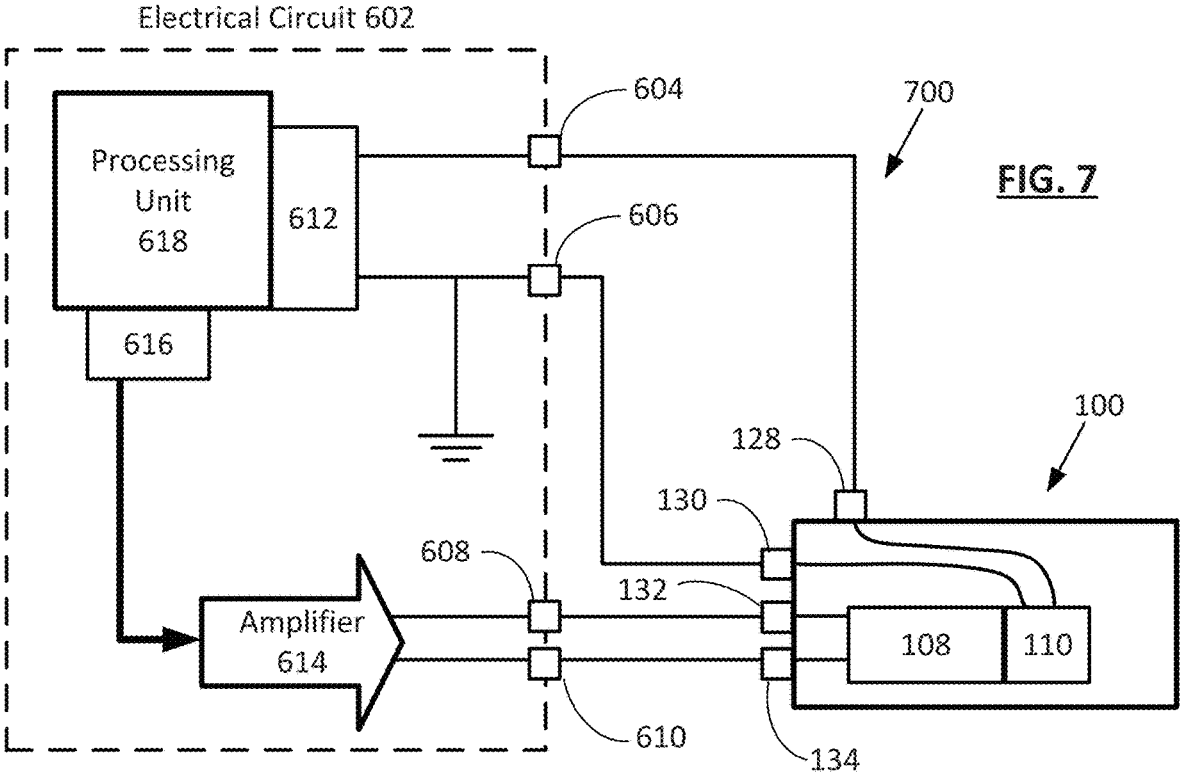
FIG. 7 is a schematic diagram of an acoustic device with a receiver and an electrical circuit, without the identifier resistor shown in FIG. 6.
Figure 8:
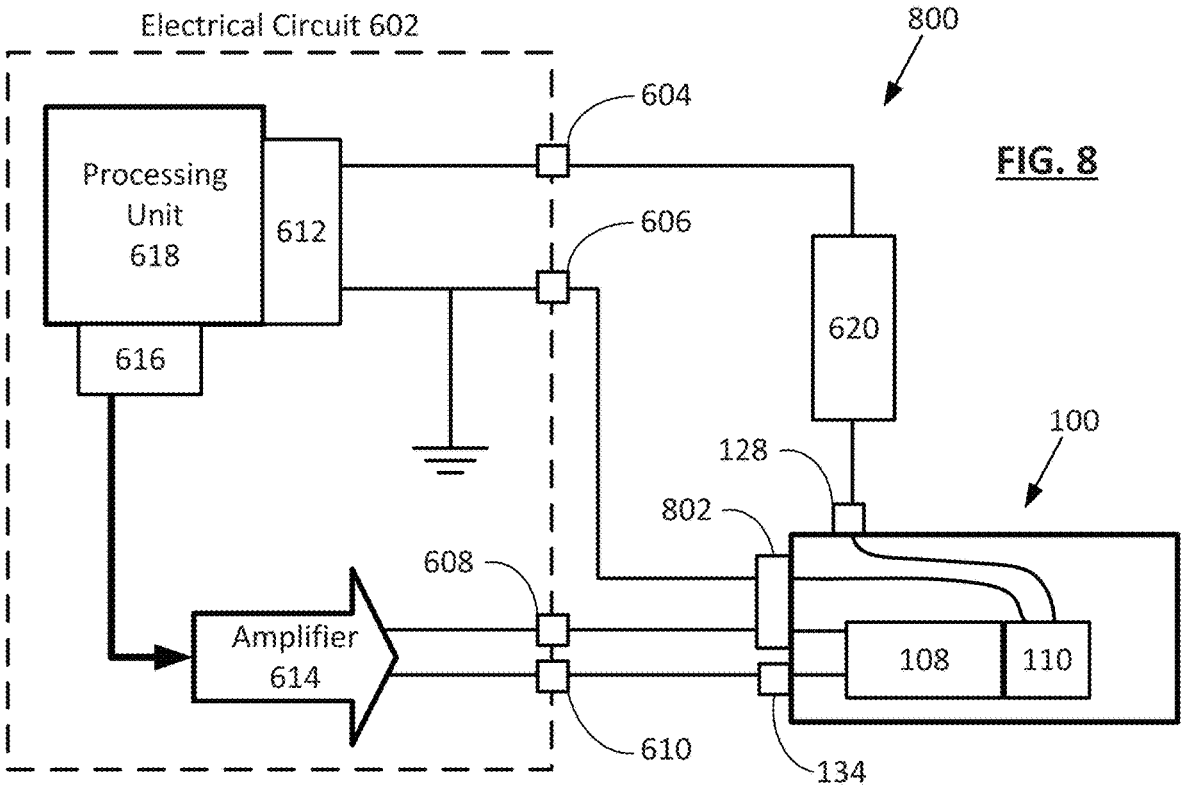
FIG. 8 is a schematic diagram of an acoustic device with a receiver and an electrical circuit as shown in FIG. 6, where two of the contacts are electrically connected.

FIGS. 6-8 show an electrical circuit 602 coupled to an acoustic receiver, which could be embodied as any of the receivers as illustrated in FIGS. 1-5. The electrical circuit 602 in may be integrated with the receiver, or it may be part of a hearing device that includes the receiver. Alternatively, the electrical circuit may be located in a host device communicably coupled to the hearing device or receiver.

FIG. 6 shows an acoustic device 600 including an electrical circuit 602, for example an integrated circuit, with four electrically isolated contacts 604, 606, 608, and 610, each of which electrically couples to a respective one of the four contacts 128, 130, 132, and 134. The contact 606 is grounded. The electrical circuit 602 contains a signal detection unit 612, an amplifier 614, an output driver 616, and a processing unit 618. The processing unit 618 controls the output driver 616 to apply an excitation signal to the first coil 108 using the amplifier 614, which for example can be an H-bridge amplifier. In response to the excitation signal, the second coil 110 produces an electrical output signal. The signal detection unit 612 can be implemented as a circuit with a preamplifier, an analog-to-digital converter, and a downsampling filter, for example, in which the signal detection unit 612 senses the signal produced by the second coil 110 and sends it to the processing unit 618. Subsequently, the processing unit 618 determines any change in the condition or state of the receiver 100 compared to the expected response. In other examples, the change in state may also indicate any change in the acoustic performance or acceleration experienced by the receiver, such as when the receiver is dropped. In an example where the acoustic device is a hearing aid, the electrical circuit 602 can also include a telecoil or microphone input, an analog-to-digital converter (ADC), and a hearing aid processor, as well as other suitable components for a hearing aid system as known in the art.

Application of an excitation signal to the first coil 108 produces a magnetic flux in or through the armature 106. The magnetic flux links the first coil 108 with the second coil 110, such that voltage in the second coil, measured at the leads 122 and 124, becomes proportional to the rate of change of current in the first coil, measured at the leads 118 and 120. The magnetic flux also causes deflection in the movable portion 144 of the armature 106 relative to the magnets 138 and 140. The armature 106 is made of ferromagnetic material such as Nickel-Iron (Ni—Fe), although other suitable ferromagnetic materials may also be used, such that the deflection causes a change in the permeability of the armature 106 as its position between the magnets 138 and 140 changes, where permeability is proportional to the magnetic flux density B and inversely proportional to the magnetic field H. The permeability of the armature equals 1 when the magnetic field H cannot increase the magnetization of the armature further and the armature is therefore fully saturated. The change in permeability is a primary cause of distortion, particularly in armature-based receivers. In some embodiments, the second coil detects this acoustic distortion.

The excitation signal applied to the first coil 108 as well as the individual inductances of the first coil 108 and the second coil 110 are known, and the mutual inductance between the two coils is the square root of the product of their individual inductances multiplied by a coupling coefficient, which is also known. Therefore, using Faraday's law, the processing unit 618 can monitor voltage induced in the second coil 110 by determining the product of the mutual inductance multiplied by the rate of change of the current in the first coil 108.

In an ideal state of the receiver or hearing device, the second coil 110 has an expected magnetic response to a given excitation signal in the form of an electrical output signal, which the processing unit 618 uses to determine the state or condition of the receiver or acoustic device. When a state of the receiver or audio device changes, the signal from the second coil 110 will differ from the expected signal. The processing unit 618 determines such a difference by comparing one or more characteristics of the output signal of the second coil with characteristic of the expected signal. The graph of FIG. 11, for example, shows one example of such comparison of magnetic responses.

In some embodiments, an electrical property detectable at an interface of the receiver or acoustic device is used to uniquely identify a receiver or a characteristic of the receiver of the acoustic device. Accurate identification of the receiver informs the electrical circuit of the operating characteristics (e.g., frequency response, loudness, etc.) of the receiver and facilitates calibration, among other benefits. In some embodiments, an electrical property of a coil alone or in combination with one or more separate resistors may be selected to uniquely identify a particular type of receiver or family of receivers based on an association of unique resistance values and receiver types. In some implementations, the resistance or inductance of the coil is selected for this purpose. For example, the wire gauge and/or number of windings of the coil may be selected to provide a desired resistance or inductance that can be detected or measured at an interface of the receiver or audio device. Not all acoustic devices enable or require receiver identification based on an impedance measurement.

In FIG. 6, the receiver includes a receiver identification resistor 620 in series with the coil 110 between contact 604 and contact 606. The resistor may be embedded within, or on, the receiver or the receiver/connector assemblies. In some implementations, the coil impedance may be the same for all receiver families and different resistance values may be selected to identify different receivers. In other implementations, the coil impedance is different for different receiver families. A greater number of unique resistance values may be obtained where unique impedance or resistance values are selected for both the coil and resistor, respectively. In FIG. 7, the receiver can be identified based only on coil impedance. Elimination of the resistor 620 in FIG. 6 reduces part count and reduces space usage within the receiver or acoustic device. The processing unit identifies the receiver based on a determination of impedance or resistance. Circuits and schemes for measuring impedance and resistance are known generally. In FIGS. 6 and 7, the impedance or resistance can be measured at contacts 604 and 606.

FIG. 8 shows yet another embodiment in which the contacts 130 and 132 of FIG. 6 are no longer electrically isolated, but rather electrically coupled at common contact, thereby forming a "three pad" configuration for the receiver. In FIG. 8, the receiver 800 has three electrically isolated contacts 128, 134, and 802. The contact 802 electrically couples to the leads 118 and 124 of the receiver 100, and also to the contacts 606 and 608 of the electrical circuit 602. Therefore, the contact 606 functions as a return for currents coming from the amplifier 610 and receives and processes the electrical output signal from the second coil 110. The device 800 determines any change in state of the receiver 100 by analyzing the electrical output signal produced by the second coil 110 in response to the excitation signal applied to the first coil 108.

Regarding the embodiments of FIGS. 6 and 8, the identification resistors 620 usually are resistors with impedance ranging from 1 kΩ to 8 kΩ. When the impedance of the coils is used for identification instead, the coils usually have an impedance of up to 2 kΩ. However, any other resistors and coils with suitable impedance values can also be used alone or in combination. Advantages in using only the impedance of the coils for identification include smaller size of the device as well as simplifying the manufacturing process, since a separate identification resistor is not required.

Figure 9:
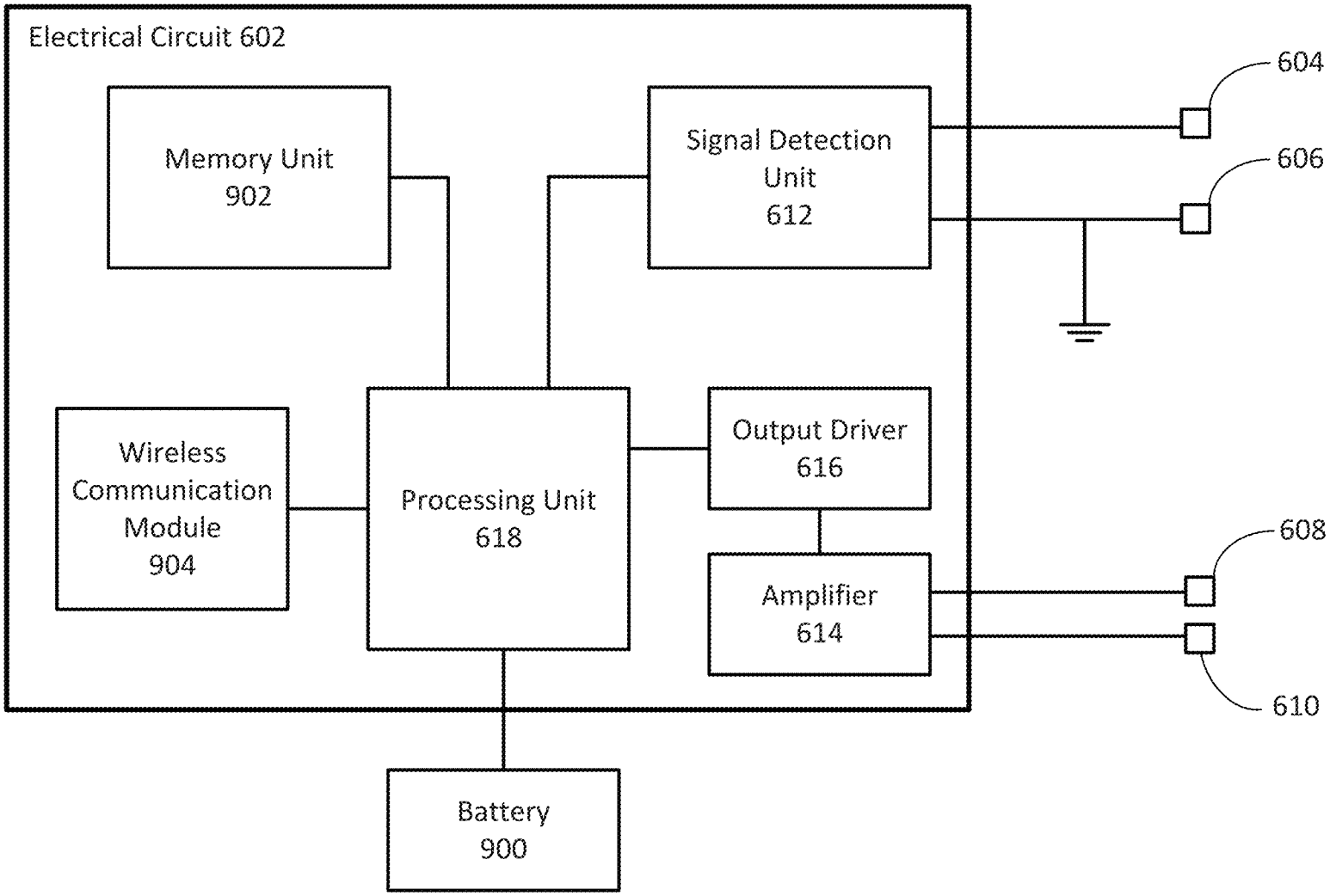
FIG. 9 is a schematic block diagram of the electrical circuit as used in the acoustic devices shown in FIGS. 6 to 8.

FIG. 9 illustrates one embodiment of the electrical circuit 602 as used in any one of the acoustic devices shown in FIGS. 6-8. The electrical circuit 602 is coupled to a battery 900 from which it receives power to operate the processing unit 618, which controls the signal detection unit 612, the output driver 616, a memory unit 902, and a wireless communication module 904. The output driver 616, upon receiving instructions from the processing unit 618, sends signals to the amplifier 614, also included in the electrical circuit 602. The memory unit 902 stores executable instructions used by the processing unit 618 that causes the processing unit to determine any changes in the state of the receiver electrically coupled with the electrical circuit 602, as well as other reference information, such as data of each unique identification resistor 620 and its impedance value as noted above. The wireless communication module 904 sends and receives signals to and from other electronic devices, such as the user's smartphone, computer, or other types of devices, connected to the acoustic device distally via the Internet or locally via Bluetooth. Other suitable wireless communication methods can also be used.

Figure 10:
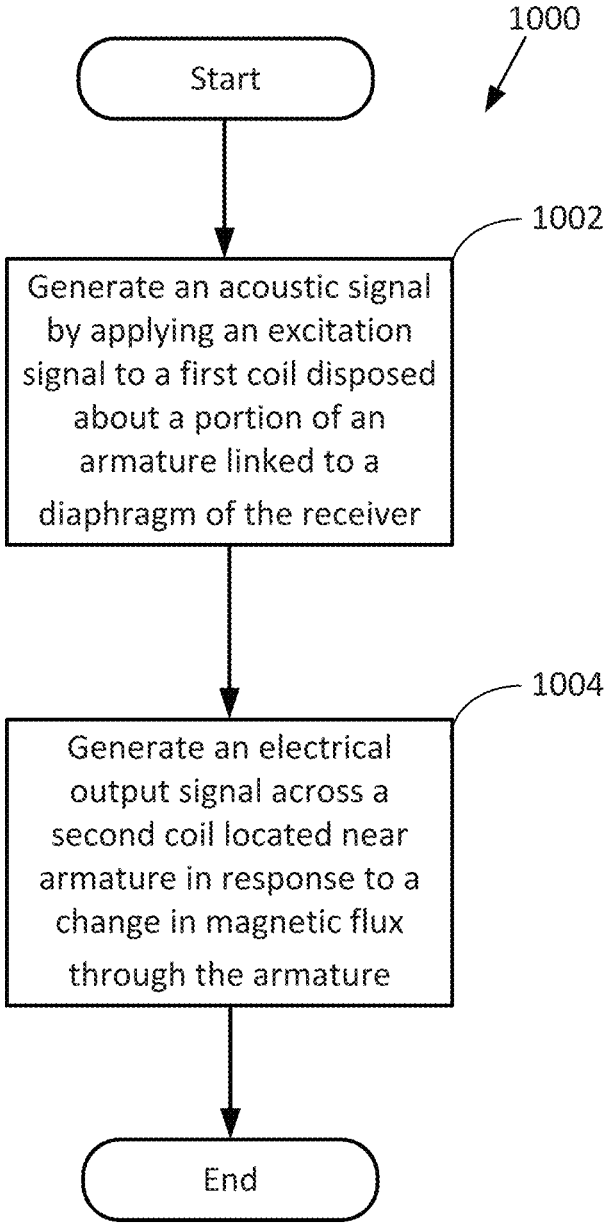
FIG. 10 is a flow chart illustrating one example of an algorithmic process or method in the acoustic device.

FIG. 10 shows one example of an algorithmic process or method 1000 used by any of the acoustic receivers in FIGS. 1-5 to generate an electrical output signal indicative of a change in the state of the receiver. In step 1002, the acoustic device generates an acoustic signal by applying an excitation signal to a first coil disposed about a portion of an armature linked to a diaphragm of a receiver in the acoustic device. Then, in step 1004, after applying the excitation signal, a second coil located near the armature generates an electrical output signal in response to a change in magnetic flux through the armature, because a change in the state of the receiver affects the magnetic flux. In one aspect of the embodiment, the flux changes in response to an obstruction in the output port of the acoustic device in one example, and in response to a detected acceleration of the device in another example.

In one embodiment, referring to the receiver 100 as an example, the first coil 108 receives an excitation signal, or a diagnostic signal, applied to the contacts 132 and 134, which can be a noise signal, a sine wave signal, a swept-sine test signal, or any suitable signal such as a voice or background noise signal, to activate the receiver 100. In some examples, the excitation signal generated by the electrical circuit could be a single tone with known parameters (e.g., magnitude, frequency and phase), or a stepped frequency signal with known parameters or a swept frequency signal with known parameters, among other signals with known parameters. Other excitation signals can also be used including, among others, chirps, pink noise, white noise, etc. Less well-defined signals can be used if with coherence checks.

This type of test can be done as device is used and would occur as the device is being used. The excitation signal may be audible or inaudible. Inaudible signals are generally imperceptible to the user because the frequency is outside the audible range, or because the amplitude or level of a signal in the audible frequency range is below the threshold of hearing, or because the signal in the audible frequency range is masked by other sound presented concurrently. Input signals having sub-audible frequencies may be best detected by an electro-acoustic transducer located in the front volume of the receiver. The use of an inaudible signal for load change diagnosis purposes will not interrupt the user's listening pleasure when the acoustic device is in use.

In response to the excitation signal, the second coil 110 detects the change in magnetic flux through the armature 106 and sends an electrical output signal through the contacts 128 and 130. In one aspect of this embodiment, the receiver 100 couples with the electrical circuit 602, where the circuit 602 sends the excitation signal to the receiver 100 and receives the output signal from the receiver 100. In one example, the electrical circuit 602 analyzes the output signal with respect to the excitation signal by obtaining and comparing the frequency domain information of the two signals, using methods such as fast Fourier transform (FFT), for example. In another aspect of the embodiment, the electrical circuit 602 measures the voltage in the first coil 108 and the second coil 110 after sending a sine wave signal to the first coil 108 and determines the voltage ratio of the two coils. Other suitable digital and analog methods of comparing such data can be used as appropriate.

Figure 11:
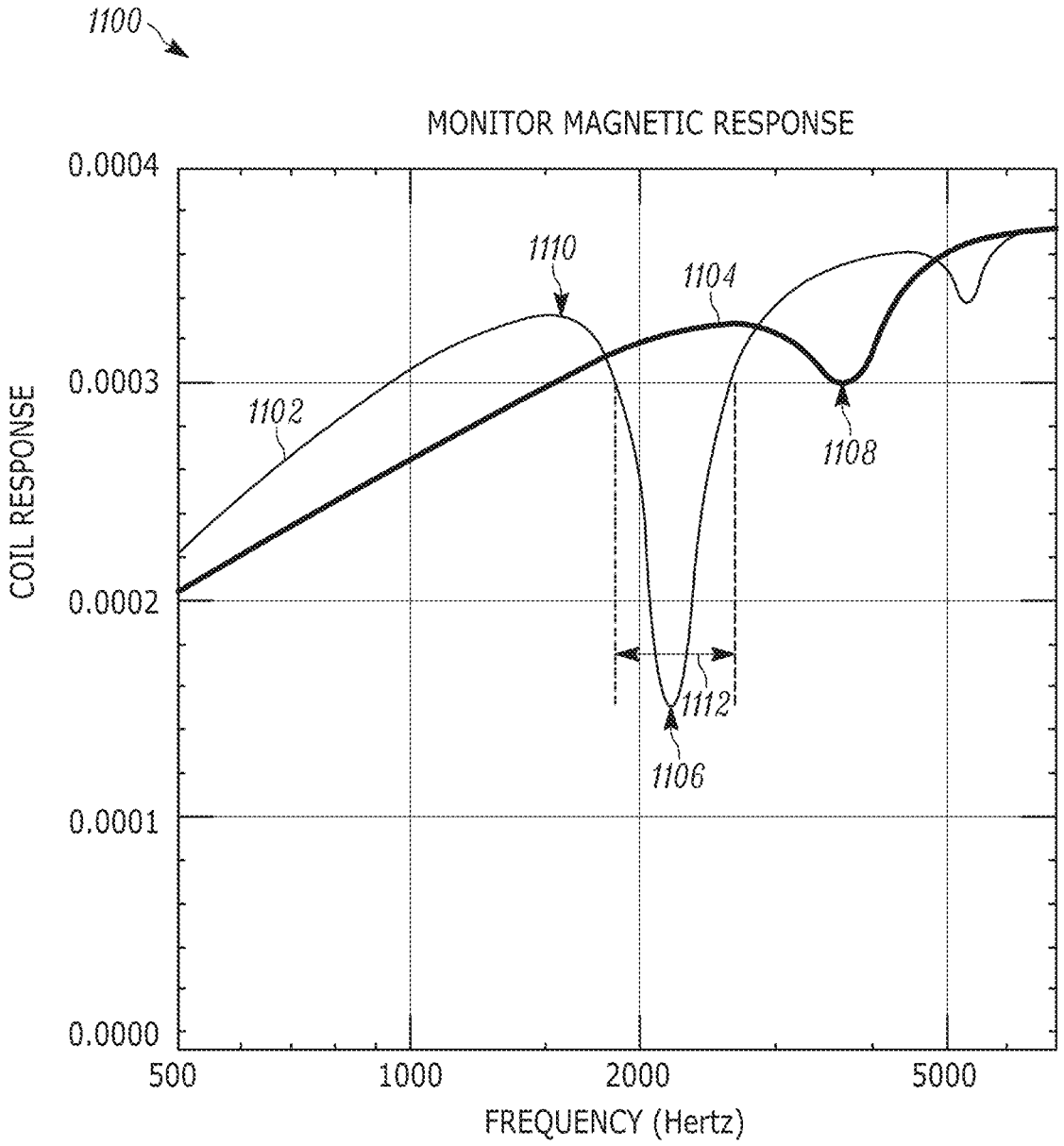
FIG. 11 is a graph illustrating the difference between expected and measured magnetic responses in the monitoring coil versus frequency when there is a considerable blockage in the acoustic device.

FIG. 11 shows an example of a magnetic response comparison graph 1100 showing both an expected magnetic response curve 1102 premeasured at the time of manufacture or during a post manufacturing calibration procedure, and a measured magnetic response curve 1104 of the second coil 110, with respect to frequency. The expected magnetic response 1102 reflects the output signal provided by the second coil 110 in response to the excitation signal sent to the first coil 108 in an ideal state, for example when the receiver 100 has no blockage in the acoustic outlet 112. The measured magnetic response 1104 reflects the output signal provided by the magnetic response of the second coil 110 when the acoustic outlet 112 has a 70% blockage, i.e., a substance such as earwax has blocked 70% of the total cross-sectional area of the acoustic outlet 112.

The electrical circuit 602 can infer that a blockage exists in the receiver 100 by analyzing the differences between the two responses 1102 and 1104. Specifically, the expected response 1102 has at least one nadir, or minimum, point therein, also known as a null position 1106, where the coil response dips down and then rises again at a frequency measured at the time of manufacture or during a post manufacturing calibration procedure. In one implementation, the electrical circuit 602 compares an amplitude of the measured response 1104 to an amplitude of the expected response at the frequency where the null position 1106 exists in the expected magnetic response 1102. In another implementation, the electrical circuit 602 compares a frequency of the null position 1108 of the measured response 1104 to the frequency of the null position 1106 of the expected response 1102. Alternatively, a change in the frequency at which a peak amplitude occurs prior to the magnetic response reaching a null position can be monitored. For example, in the expected response 1106, the peak point 1110 occurs at about 1600 Hz immediately before diving into the null position 1106 as illustrated in FIG. 11. Another approach involves comparing a "null bandwidth" of the magnetic response to a reference bandwidth for a given signal amplitude. FIG. 11 shows a bandwidth 1112 around the null 1106. Alternatively, the bandwidth can be measured around null at 1108.

Figure 12C:
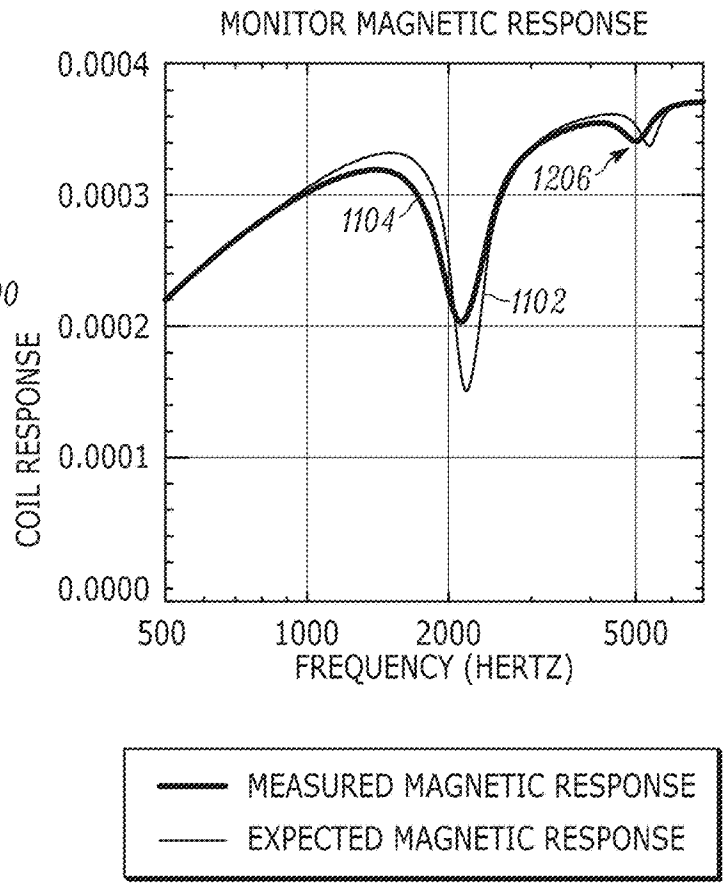
FIGS. 12-14 include partial cutaway views of the receiver as shown in FIG. 1 showing the end portion of the housing and the barrier located therein, as well as graphs depicting a relationship between obstruction, the end user experience, and the coil response.
Figure 12A:
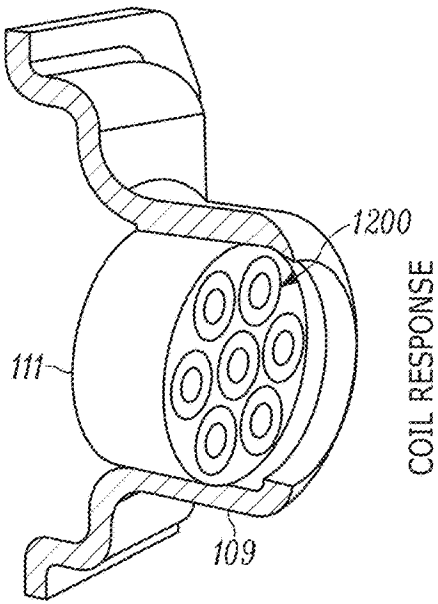
Figure 12B:
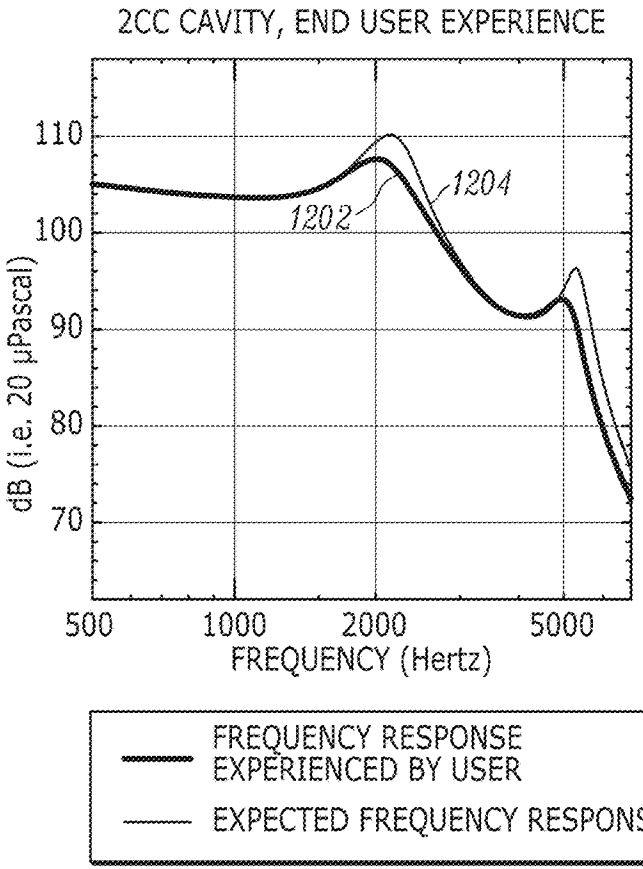
Figure 13C:
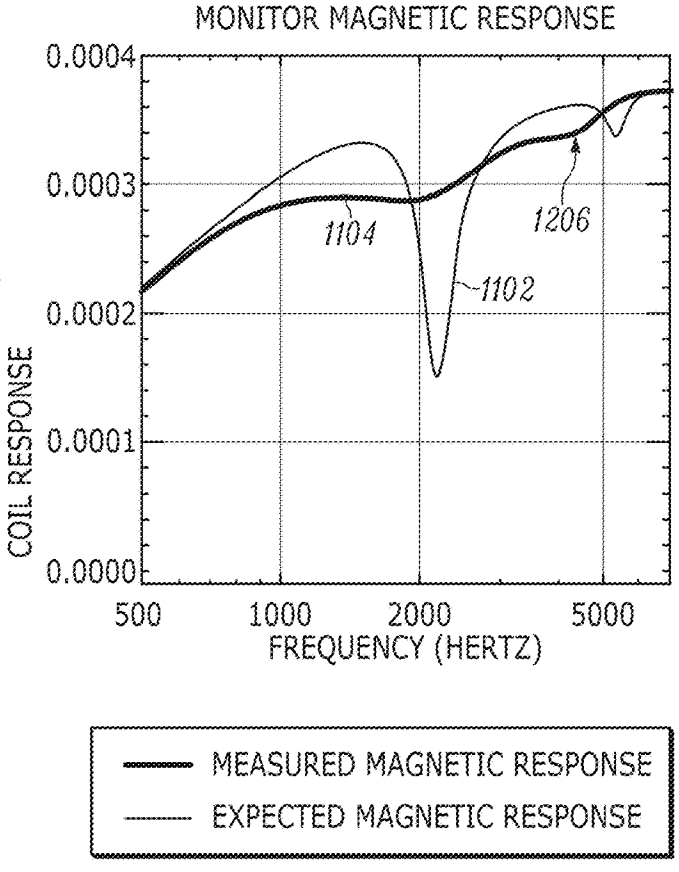
Figure 13A:
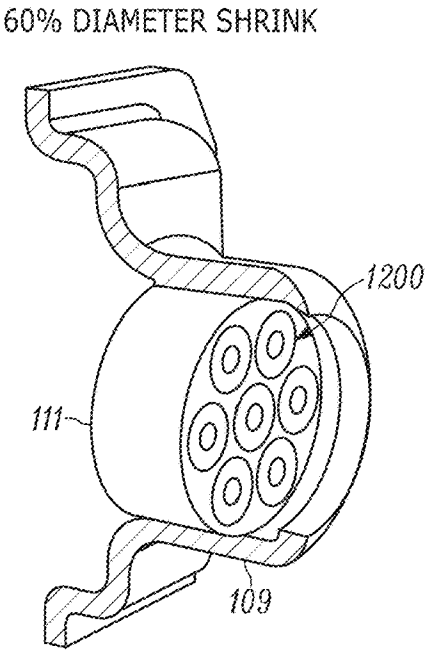
Figure 13B:
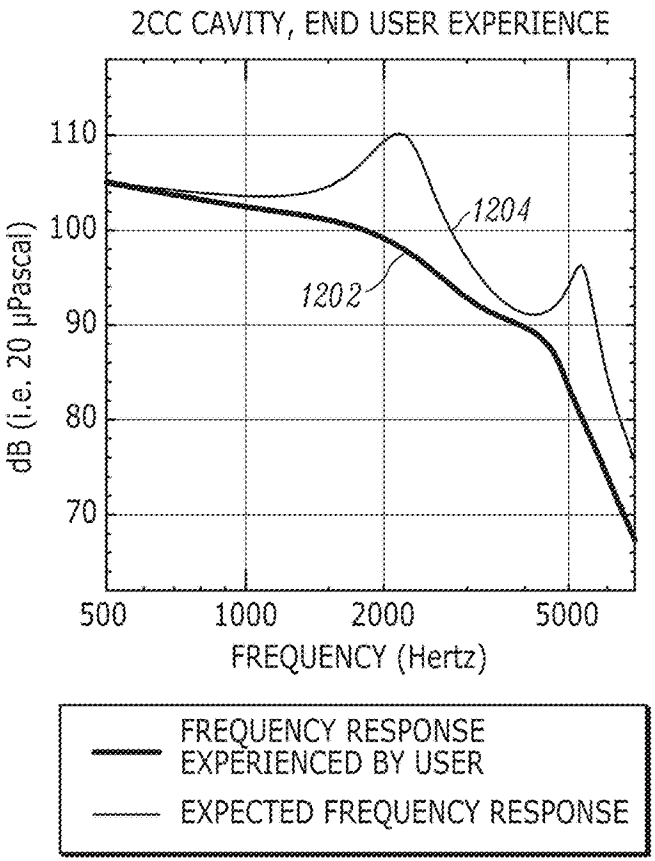
Figure 14C:
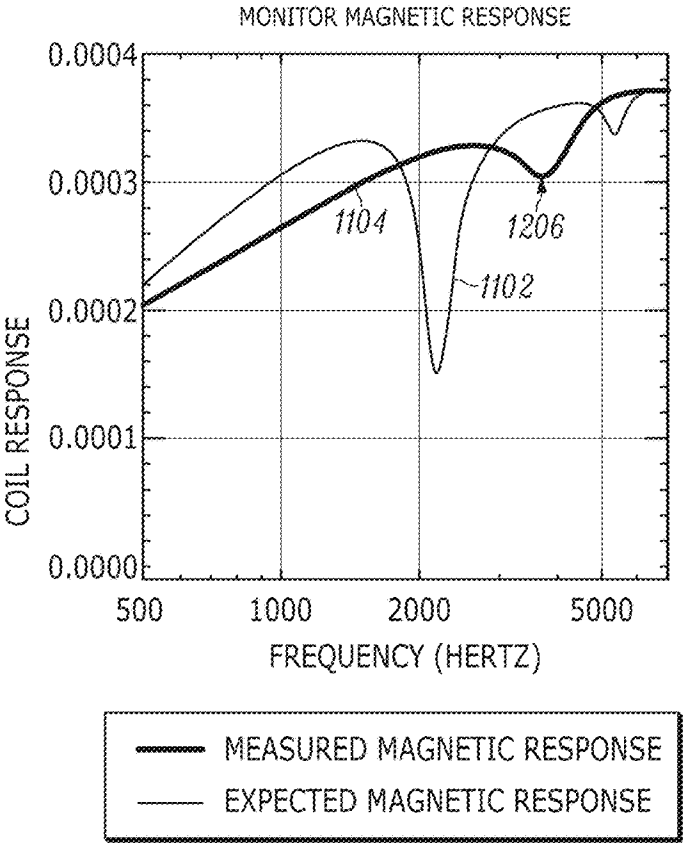
Figure 14A:
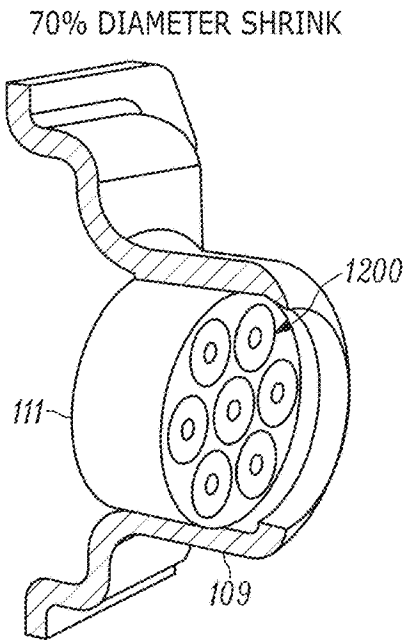
Figure 14B:
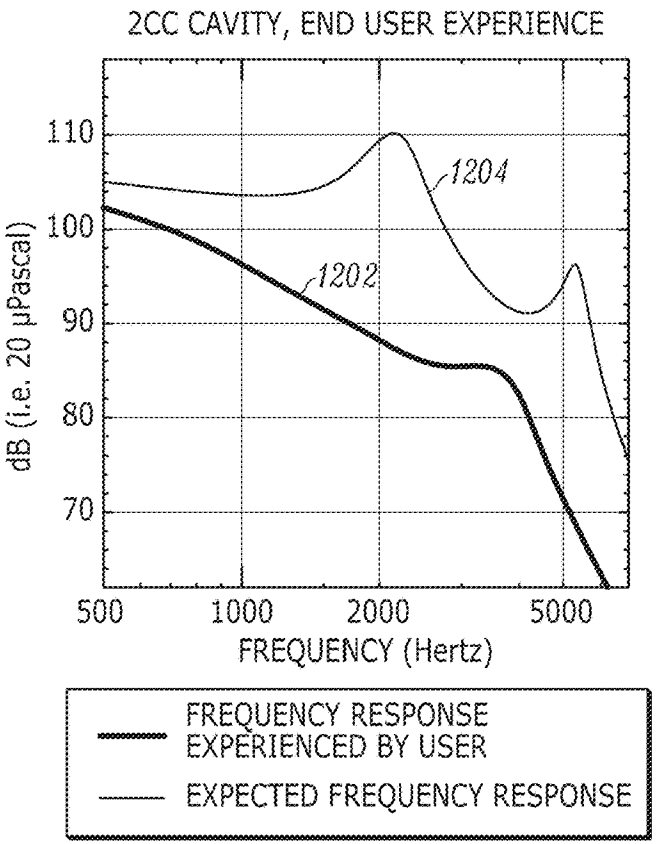

FIGS. 12A, 13A, and 14A show partial cutaway views of the housing 102 along the line A-A in FIG. 1 resulting in a closeup view of the end portion 109 and the barrier 111 with various levels of obstruction 1200 in the barrier 111. FIGS. 12B, 13B, and 14B show the relationship between the obstruction 1200 in the barrier 111 and the frequency response experienced by the user (shown as a measurement in a 2 CC cavity which simulates the End User Experience) for various levels of obstruction 1200, i.e. the difference between a frequency response experienced by the user 1202 and an expected frequency response 1204 as the obstruction 1200 increases. FIGS. 12C, 13C, and 14C show the relationship between obstruction 1200 in the barrier 111 and the Magnetic Response of the coil for various levels of obstruction 1200, i.e. the difference between the expected magnetic response curve 1102 and the measured magnetic response curve 1104 of the coil as the obstruction 1200 increases. FIG. 12 pertains to an obstruction level equivalent to 50% diameter shrink in the barrier 111, FIG. 13 pertains to 60% diameter shrink, and FIG. 14 pertains to 70% diameter shrink. With increasing obstruction, generally, there is an overall attenuation of frequencies experienced by the user, particularly at middle and higher frequencies. FIGS. 12A, 13A, and 14A show the obstruction 1200 occurring at an output of the receiver, but the obstruction could be anywhere along the sound output path of the acoustic device. The coil response allows the change in operation or performance to be monitored without measuring the acoustic output of the device. FIGS. 12C, 13C, and 14C also show the magnitude of the nulls 1206 in the coil response tending to decrease and shift toward lower frequencies with increasing obstruction 1200.

Upon detecting a change in the state of the receiver, the electrical circuit 602 sends remote communication of notifications such as resulting diagnostic data or other information to a remote device which may be, for example, a mobile user device such as a smartphone, wearable, or other mobile device, via the wireless communication module 904. Additionally, or alternatively, the remote device is a cloud-based server, or a diagnostic test system which diagnoses the acoustic receiver. In one aspect of this embodiment, the remote device determines a change in the state of the receiver by receiving data from the acoustic device indicative of the characteristics of the output signal provided by the second coil. In another aspect of the embodiment, the remote device is a computer used by an audiologist to whom the hearing device transmits data such that the audiologist can keep track of the status of the hearing devices of his or her customers.

In one example, the acoustic device includes input/output devices such as in-ear insertion sensors which may be capacitive sensors that detect when a user inserts the hearing aid or hearing device into an ear and when the user removes the hearing aid or hearing device from the ear. The acoustic device automatically activates the diagnostic operation to determine whether an acoustic load has changed upon removal of from the ear. In one example, the acoustic device includes visual output devices such as LEDs so that a user or technician receives visual notification of sensed conditions. In other embodiments, the electrical circuit provides one or more audible tones, such as a light buzz sound, or a message indicating a need for service based on the diagnosis. The memory of the electrical circuit stores the diagnostic data for later interrogation by a service technician. In other embodiments, other suitable input/output devices may be used to indicate the status of the acoustic device or permit sharing of data on the device. Advantages of having a notification method as listed above include making the user aware of the state of the device, and if necessary, take the device to a service technician for maintenance, which can extend the life of the device. Also, notifying the user of a state change early on can prevent the device from sustaining further damage, which occurs when the user is unaware of the need for maintenance and keeps using the device despite its decreased performance.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

What is claimed is:

1. An acoustic receiver comprising:

a housing;

a diaphragm disposed in the housing and at least partially defining a front volume and a back volume, the front volume acoustically coupled to an acoustic output of the receiver;

an armature, disposed in the housing, linked to the diaphragm;

a first coil, disposed in the housing, disposed about a portion of the armature, the first coil having two leads; and a second coil, disposed in the housing, positioned to respond to a change in magnetic flux through the armature, the second coil having two leads, wherein the first coil and the second coil are wired independently.

2. The acoustic receiver of claim 1 further comprising an electrical interface including at least four discrete electrical contacts, each electrical contact electrically coupled to a corresponding coil lead.

3. The acoustic receiver of claim 2, wherein the receiver is configured to generate an acoustic signal in response to an excitation signal applied to the first coil, and the second coil is configured to produce an electrical output signal indicative of operation of the receiver.

4. The acoustic receiver of claim 3, wherein the electrical output signal is indicative of obstruction of the acoustic signal.

5. The acoustic receiver of claim 3, wherein the electrical output signal is indicative of distortion in the acoustic signal.

6. The acoustic receiver of claim 1, the housing having a quad-contact interface, wherein each lead is electrically coupled to a corresponding contact of the interface and the contacts are electrically isolated from each other.

7. The acoustic receiver of claim 1, wherein the second coil is wound around at least a portion of an outer surface of the first coil, or side-by-side with the first coil or intertwined with the first coil.

8. The acoustic receiver of claim 7, wherein the second coil has a smaller wire gauge than the first coil.

9. The acoustic receiver of claim 7, wherein each coil has a different number of turns.

10. The acoustic receiver of claim 2 further comprising an electrical impedance identifying the receiver, the electrical impedance detectable at contacts of the electrical interface.

11. An acoustic device comprising:

an armature-based acoustic receiver having a diaphragm linked to an armature, a first coil disposed about a portion of the armature, and a second coil disposed proximate the armature, the diaphragm at least partially defining a back volume and a front volume of a housing, the front volume acoustically coupled to an output of the acoustic device, the receiver configured to produce an acoustic signal at the output of the acoustic device in response to an excitation signal applied to the first coil, the second coil positioned to generate an electrical output signal in response to a change of magnetic flux of the armature, and an electrical circuit coupled to the second coil, the electrical circuit configured to receive the electrical output signal from the second coil, wherein the electrical output signal of the second coil is indicative of a change in state of acoustic device.

12. The acoustic device of claim 11, the state of the acoustic device is an acoustic performance, the electrical circuit operative to determine a change in the acoustic performance based on a change in the electrical output signal of the second coil.

13. The acoustic device of claim 12, the electrical circuit operative to apply the excitation signal to the first coil and assess a change in a characteristic of the electrical output signal of the second coil, wherein the characteristic includes a null position, a peak amplitude, or null bandwidth of the detected magnetic response.

14. The acoustic device of claim 11, the state of the acoustic device is an acceleration, the electrical circuit operative to determine a change in the acceleration based on a change in the electrical output signal of the second coil.

15. The acoustic device of claim 11 further comprising an electrical interface with three electrically isolated contacts, each of the first and second coils have a first lead and a second lead, wherein one of the three contacts connects the first lead of the first coil to the first lead of the second coil, each of the other two contacts configured to connect to a corresponding one of the second leads of the first and second coils.

16. The acoustic device of claim 11 further comprising an electrical interface with four electrically isolated contacts, each of the first and second coils having a first lead and a second lead, wherein each contact is electrically coupled to a corresponding lead of the first coil and the second coil.

17. The acoustic device of claim 11, wherein the second coil is wound in at least one of the following configurations: around at least a portion of an outer surface of the first coil, side-by-side with the first coil, or intertwined with the first coil.

18. An acoustic device comprising:

an armature-based acoustic receiver having a diaphragm linked to an armature, a first coil disposed about a portion of the armature, and a second coil disposed proximate the armature, the diaphragm at least partially defining a back volume and a front volume of a housing, the front volume acoustically coupled to an output of the acoustic device, the receiver configured to produce an acoustic signal at the output of the acoustic device in response to an excitation signal applied to the first coil, the second coil positioned to generate an electrical output signal in response to a change of magnetic flux of the armature, the second coil having an electrical property selected to uniquely identify the armature-based acoustic receiver or a property of the armature-based acoustic receiver; and an electrical circuit coupled to the second coil, the electrical circuit configured to receive the electrical output signal from the second coil, wherein the electrical output signal of the second coil is indicative of a change in operation of acoustic device.

19. The acoustic device of claim 18 further comprising an interface coupled to the second coil, wherein the electrical property of the second coil may be interrogated via the interface to identify the armature-based acoustic receiver or a property of the armature-based acoustic receiver.

20. The acoustic device of claim 19, wherein the interface is part of the receiver and the electrical property of the second coil includes resistance.

* * * * *